US005297121A

United States Patent [19]

Sepehri

[11] Patent Number: 5,297,121

[45] Date of Patent: Mar. 22, 1994

[54] ECCENTRIC MOUNTED WATCH

[76] Inventor: Seyyed S. Sepehri, 205 McGuirk Dr., Glen Burnie, Md. 21061

[21] Appl. No.: 960,874

[22] Filed: Oct. 14, 1992

[51] Int. Cl.[5] ..... G04B 19/04; G04B 19/06

[52] U.S. Cl. ..... 368/228; 368/223

[58] Field of Search ..... 368/223-242

[56] References Cited

U.S. PATENT DOCUMENTS

| | | | |
|---|---|---|---|
| 1,989,584 | 1/1935 | Biedenfeld | 368/238 |
| 4,601,585 | 7/1986 | Farley | 368/80 |
| 5,043,955 | 8/1991 | Dubois et al. | 368/228 |
| 5,172,350 | 12/1992 | Walen et al. | 368/238 |

*Primary Examiner*—Bernard Roskoski
*Attorney, Agent, or Firm*—Walter G. Finch

[57] ABSTRACT

An eccentrically designed watch is provided wherein the center of rotation of a watch is not located at the center of the watch face and is shifted vertically upwardly. The eccentricity is not observed by the user. A watch is provided in which the eccentricity factor is achieved in such a way to minimize working hours (only visual) eight (8) to four (4) hours and maximize four (4) to eight (8) non-working hours. Increments and actual numbers on the face of the watch increases in size from twelve (12) to six (6) hours and decreases from six (6) to twelve (12) hours to aid this effect.

3 Claims, 1 Drawing Sheet

ECCENTRIC MOUNTED WATCH

BACKGROUND AND SUMMARY OF THE INVENTION

This invention relates generally to timing devices, and more particularly to eccentrically mounted and operated watches.

| DISCUSSION OF PRIOR ART | |
|---|---|
| Hetzel | D-209,070 |
| Nomizu | D-311,692 |
| Kawashima | D-314,518 |
| Rachofsky | 4,541,726 |

The Hetzel patent No. D-209,070 is for a watch which has been designed with short bars at the top (near the 12 hour) and progressively longer bars at the bottom (near the 6 hour). This would give the user the illusion that the hours between 4 to 8 are longer than those between 8 and 4, since the illusion which the bars create seems to make certain hours appear larger than others.

The watches designed by Nomizu (D-311,692) and Kawashima (D-314,518) have their lower portions flattened. This in turn seems to make the hour increments between 4 to 8 hours look longer.

The Rachofsky U.S. Pat. No. 4,541,726 teaches a watch which breaks the day up into 25 hours. This helps people who have a psychological need for an extra hour in the day to accomplish daily tasks.

SUMMARY OF THE INVENTION

A unique eccentrically mounted watch is provided having an eccentric design. The center of rotation of the watch is not located at the center of the watch face, but is shifted vertically upwardly. The eccentricity of the watch, however, is not seen by the user of the watch. An adjusting knob is provided which is also eccentrically arranged.

The eccentricity factor of the watch is achieved in such a way to minimize working hours—that is—only visual. For example, a design is provided which has minimized eight (8) to four (4) hours and maximized four (4) to eight (8) hours, the latter relating to non-working hours.

The increments as well as the actual numbers on the face of the watch increase in size from twelve (12) to six (6) hours and decrease from six (6) to twelve (12) hours to help carry out this effect.

Because the center of rotation in the watch (final design) is hidden, it leaves the user of the watch with a question. It also leaves the user of the watch with a good feeling since the working hours are visually minimized.

OBJECTS OF THE INVENTION

It is an object of this invention to provide an eccentrically designed watch.

Still another object of this invention is to provide an eccentrically designed watch wherein the center of rotation of the watch is not located at the center of the watch face, but is shifted vertically upwardly.

To provide a watch which is eccentricity designed, so that the eccentricity is not observed by the user, is another object of the invention.

To provide a watch in which the eccentricity factor is achieved in such a way to minimize working hours (only visual) eight (8) to four (4) and maximize four (4) to eight (8) non-working hours, is still another object of this invention.

Still another object of this invention is to provide increments and actual numbers on the face of the watch which increase in size from twelve (12) to six (6) hours and decrease, from six (6) to twelve (12) hours to aid in a visual effect.

Still another object of this watch invention is to hide the final design of the center of rotation of the watch so that the user has a question, and also to leave the user with a good feeling since the working hours are visually minimized.

DESCRIPTION OF THE DRAWINGS

These and other objects and advantages of this invention will become more apparent and obvious from the accompanying drawings and specification in which.

DESCRIPTION OF THE INVENTION

Figure 1:
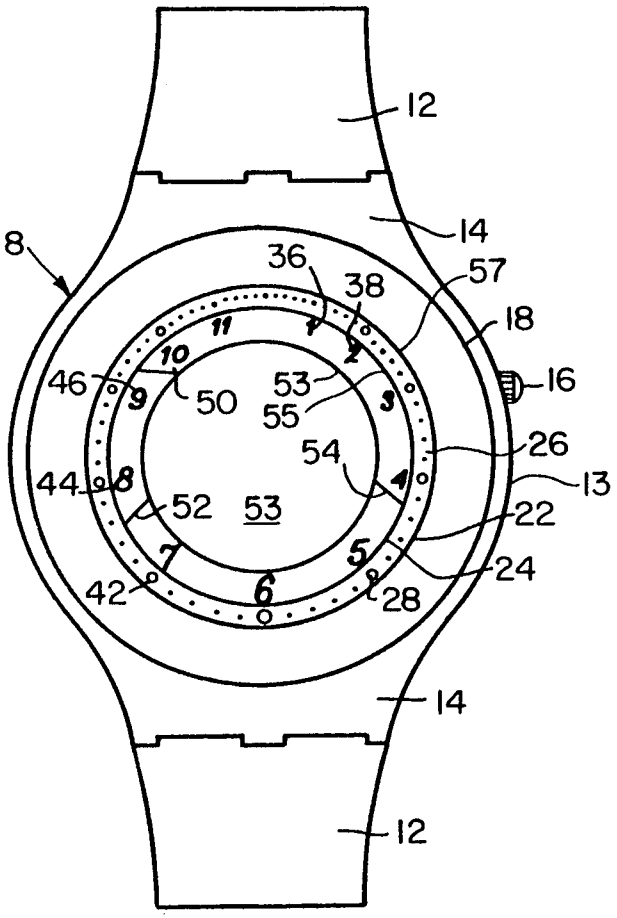
FIG. 1 is a top view of the final design of watch incorporating features of this invention.

Referring now to FIG. 1 of the drawings, there is shown a final design of a watch 8 having two straps or bands 12, a framework 14 for the watch 8, with the two straps 12 connected on opposite sides thereof to the framework 14. A casing 13 is centrally positioned in the framework 14. A crown or adjusting knob 16 is positioned on the side of the casing 13.

A bezel 26 is positioned symmetrically in the casing 13. It consists of two circles 22 and 24 with bezel markings 42, 28 etc. for example. The watch hands 52, 54, 50 are shown between the inner ring 24 and the inner circle 53. The hour mark indicia are indicated by reference numerals 46, 44, 36, 38, for example. The face of the clock 8 is indicated by reference numeral 53.

The watch 8 of FIG. 1 is a solidified model of the watch clock face 53 where the center of rotation of the hands 50, 52, 54 is hidden and therefore appears to be the same as that of the watch face 53.

Figure 2:
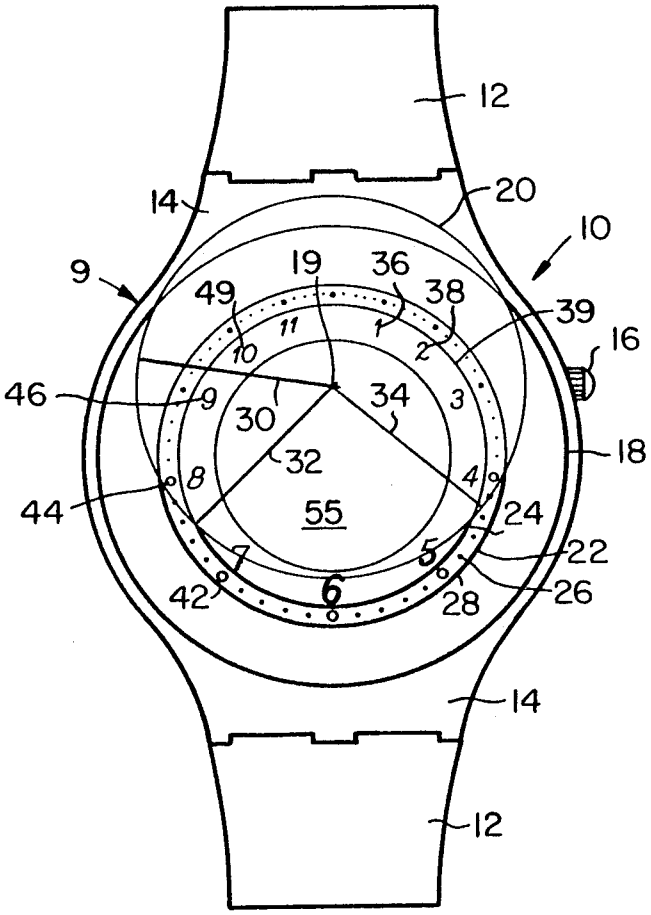
FIG. 2 is a semi-transparent top view of a watch showing the eccentrically mounted hands incorporating unique features of this invention.

Referring now to FIG. 2, there is shown the design of a watch 9 more clearly illustrating the eccentricity features of this invention.

In FIG. 2, there is shown a transparent model of a watch 9 clock face 55, where the center of rotation 19 of the hands 30, 32 and 34 is eccentrically arranged with respect to the actual center of the watch or clock face 55 as indicated by the circle 20.

The reference numerals 36, 38, 46, 49 are indicia for the hour numerals.

This unique watch 9 that is provided is of an eccentric design. The center of rotation 19 of the watch 9 is not at the center of the watch face 55. It is shifted vertically upwardly. The eccentricity of the watch 9, however, is not seen by the user of the watch 9. The adjusting knob or crown 16 is also eccentrically arranged.

The eccentricity factor of the watch 9 is achieved in such a way to minimize working hours—that is—only visual. For example, the watch 9 minimizes eight (8) to four (4) hours and maximizes four (4) to eight (8) hours, the latter relating to non-working hours.

The increments as well as the actual numbers on the watch face 55 of the watch 9 increase in size from twelve (12) to six (6) hours and decrease from six (6) to twelve (12) hours to help this visually deceptive effect.

Because the center of rotation in the watch 9 (final design) is hidden, it leaves the user of the watch 9 with a question. It also leaves the user of the watch 9 with a good feeling since the working hours are visually minimized.

Obviously, many modifications and variations of the present invention are possible in light of the above teachings. It is, therefore, to be understood that within the scope of the appended claims, the invention may be practiced otherwise than as specifically described.

What is claimed is:

1. A watch for creating a visual illusion, said watch having an upper end and a lower end, said watch comprising a central framework constituting the rigid body of said watch, a casing centrally positioned in said framework, a circular bezel having time increments marked thereon centrally positioned in said casing, a plurality of watch hands rotating about a fixed fulcrum point, and a round, opaque portion covering said fixed fulcrum point, wherein said casing, said circular bezel, and said round, opaque portion are concentrically positioned and thereby share a common center point, and whereby said fixed fulcrum point about which said watch hands rotate is positioned radially outward from said common center point toward said upper end of said watch.

2. A watch for creating a visual illusion as recited in claim 1, wherein the first half of said time increments on said circular bezel increase in a clockwise fashion from said upper end of said watch to said lower end of said watch as they are marked radially therearound, and whereby the second half of said time increments on said circular bezel decrease in a clockwise fashion from said lower end of said watch to said upper end of said watch as they are marked radially therearound.

3. A watch for creating a visual illusion as recited in claim 1, wherein said watch further comprises a number of numerical hour indicia positioned adjacent said time increments along said circular bezel, whereby said numerical hour indicia increase in a clockwise fashion from said upper end of said watch to said lower end of said watch as they are marked radially therearound, and whereby said numerical hour indicia decrease in a clockwise fashion from said lower end of said watch to said upper end of said watch as they are marked radially therearound.

* * * * *